US009604486B2

(12) United States Patent
Hofer et al.

(10) Patent No.: US 9,604,486 B2
(45) Date of Patent: Mar. 28, 2017

(54) SEALED THERMACOLOR TAG AND LABEL STRUCTURE

(71) Applicant: ZIH Corp., Lincolnshire, IL (US)

(72) Inventors: Gene A. Hofer, Lake Zurich, IL (US); Steven Vandercar, Rolling Meadows, IL (US); David A. Kelly, Oshkosh, WI (US)

(73) Assignee: ZIH Corp., Lincolnshire, IL (US)

( * ) Notice: Subject to any disclaimer, the term of this patent is extended or adjusted under 35 U.S.C. 154(b) by 0 days.

(21) Appl. No.: 14/463,268

(22) Filed: Aug. 19, 2014

(65) Prior Publication Data

US 2016/0052323 A1 Feb. 25, 2016

(51) Int. Cl.

| | |
|---|---|
| ***B41M 5/42*** | (2006.01) |
| ***B41M 5/44*** | (2006.01) |
| ***B41M 5/48*** | (2006.01) |
| ***B41M 5/323*** | (2006.01) |
| ***B41M 5/333*** | (2006.01) |
| ***B41M 5/34*** | (2006.01) |

(52) U.S. Cl.

CPC ..... *B41M 5/44* (2013.01); *B41M 5/323* (2013.01); *B41M 5/3335* (2013.01); *B41M 5/34* (2013.01); *B41M 5/42* (2013.01); *B41M 5/48* (2013.01); *B41M 5/426* (2013.01); *B41M 2205/04* (2013.01); *B41M 2205/38* (2013.01); *B41M 2205/40* (2013.01); *B41M 2205/42* (2013.01)

(58) Field of Classification Search

CPC . B41M 5/42; B41M 5/44; B41M 5/48; B41M 2205/04; B41M 2205/40

USPC ..... 503/200–226

See application file for complete search history.

(56) References Cited

U.S. PATENT DOCUMENTS

| | | | | |
|---|---|---|---|---|
| 4,999,334 | A | 3/1991 | Mehta et al. | |
| 5,236,884 | A * | 8/1993 | Boggs | B41M 5/323 430/200 |
| 5,462,909 | A | 10/1995 | Lakes et al. | |
| 5,524,934 | A | 6/1996 | Schwan et al. | |
| 5,529,934 | A | 6/1996 | Chelladurai et al. | |
| 5,803,505 | A | 9/1998 | Schwan et al. | |
| 5,810,397 | A | 9/1998 | Mehta et al. | |

(Continued)

FOREIGN PATENT DOCUMENTS

| | | |
|---|---|---|
| EP | 0747871 A2 | 12/1996 |
| EP | 1972459 A1 | 9/2008 |

(Continued)

OTHER PUBLICATIONS

The Break Room at FlexoExchange; printing UV inkt on direct thermal economy [online] [retrieved Feb. 26, 2014]. Retrieved from the Internet: <URL: http://www.flexoexchange.com/forum/viewtopic.php?f=4&t=915&start=0>. (dated Feb. 26, 2014) 4 pages.

(Continued)

*Primary Examiner* — Bruce H Hess

(57) ABSTRACT

Provided is thermally imagable media in which selected areas may be thermally activated to change color. The thermally imagable media includes a substrate having a first and second surface, the first surface supporting a thermally imagable coating, an extender coating, and a top coating such that when activated the thermally imagable coating produces a visible color. The thermally imagable media is activated in a direct thermal printer.

21 Claims, 5 Drawing Sheets

(56) References Cited

U.S. PATENT DOCUMENTS

| | | | | |
|---|---|---|---|---|
| 5,814,579 | A | 9/1998 | Dotson et al. | |
| 5,840,657 | A | 11/1998 | Mehta et al. | |
| 5,888,283 | A | 3/1999 | Mehta et al. | |
| 5,984,363 | A | 11/1999 | Dotson et al. | |
| 6,015,589 | A | 1/2000 | Mehta et al. | |
| 6,258,746 | B1 | 7/2001 | Mehta et al. | |
| 7,576,036 | B2 * | 8/2009 | Nagasaki | B41M 5/423 427/150 |
| 8,476,191 | B2 * | 7/2013 | Hada | B41M 5/3275 427/152 |
| 8,524,633 | B2 * | 9/2013 | Masuda | B41M 3/144 283/92 |
| 8,536,087 | B2 * | 9/2013 | Harrison | B41M 5/30 503/201 |
| 2011/0251060 | A1 | 10/2011 | Harrison et al. | |

FOREIGN PATENT DOCUMENTS

| | | |
|---|---|---|
| EP | 2722190 A1 | 4/2014 |
| JP | S6461287 | 3/1989 |

OTHER PUBLICATIONS

The Break Room at FlexoExchange; Thermal Yellow [online] [retrieved Feb. 26, 2014]. Retrieved from the Internet: <URL: http://www.flexoexchange.com/forum/viewtopic.php?f=4 &t=1259>. (dated Feb. 26, 2014) 4 pages.

Zebra Technologies IQ Color Video Demo [online] [retrieved Oct. 21, 2014]. Retrieved from the Internet: <URL: https://www.youtube.com/watch?v=nVgOddxG_cA>. (dated Oct. 21, 2014) 2 pages.

International Search Report and Written Opinion for corresponding International Application No. PCT/IB2015/055144 mailed on Sep. 25, 2015.

* cited by examiner

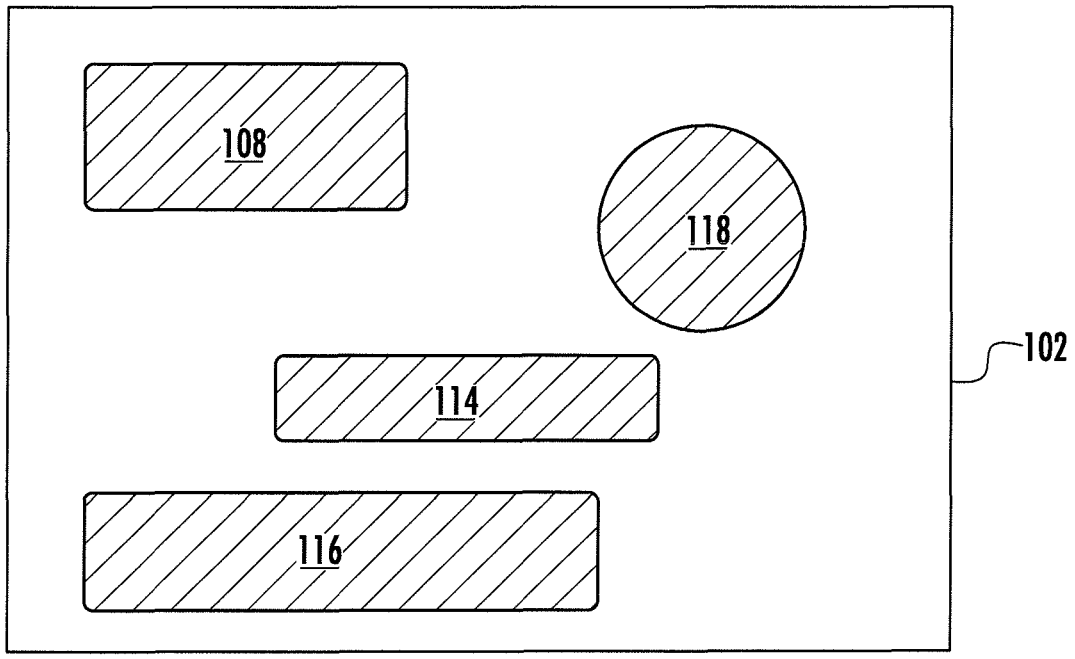
FIG. 3
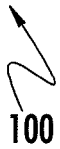

SEALED THERMACOLOR TAG AND LABEL STRUCTURE

FIELD OF THE INVENTION

The present invention relates generally to thermally imagable media, and more particularly to a direct thermal imaging record with a sealed thermally imagable coating.

BACKGROUND OF THE INVENTION

Direct thermal printing is a non-impact printing process where heat is applied to thermal paper to produce a visible color change. Prior to printing, the thermal paper is coated with a formulation comprising a low melting point solid, acid, and dye, the dye being one that changes color upon a change in pH. Heat is then applied by a printhead as the paper travels through a thermal printer. The application of heat melts the solid, allowing the dye and acid to react resulting in a color change. The printhead may be configured to heat certain areas of the thermal paper thereby activating some or all of the color chemistry such that words, images, or other indicia may be created.

Applicant has identified a number of deficiencies and problems associated with conventional thermal papers and thermal printing processes. Through applied effort, ingenuity, and innovation, many of these identified problems have been solved by developing solutions that are included in various embodiments of the present invention, which are described in detail below.

BRIEF SUMMARY OF THE INVENTION

Embodiments of the present invention provide thermally imagable media that produces a color image when activated. In one embodiment, the thermally imagable media comprises a substrate having a first and second surface, the first surface supporting a thermally imagable coating, an extender coating that overlies the first thermally imagable coating, and a top coating that overlies the extender coating such that, when activated, the thermally imagable coating produces a color.

In certain embodiments, the substrate having a first and second surface is a clay-coated paper stock. In one embodiment, the substrate is a calcite-clay coated paper stock.

In one embodiment, the extender coating is applied with a 2.0 to 6.0 billion cubic microns (bcm) anilox roller. The extender coating is an ink without a colorant. In certain embodiments, the extender coating comprises acrylic resins, wax, and water.

In a further embodiment, the thermally imagable coating comprises a colorformer and developer. The colorformer comprises one or more of cyan, magenta, yellow, and black. In some embodiments, the colorformer comprises two or more of cyan, magenta, yellow, and black. In yet another embodiment, the colorformer comprises each of cyan, magenta, yellow, and black. The thermally imagable coating is activated to form one or more of a symbol, image, or word.

In certain embodiments, the top coating is an ink without a colorant. In one embodiment, the top coating comprises a water soluble polymer, crosslinking agents, and fillers. In another embodiment, the top coating comprises 5-10% clay, 10-20% polymer solids, and 80-85% water.

In yet another embodiment, the thermally imagable media is a continuous web for producing a series of thermally imagable records.

In certain embodiments, the first surface supports a second thermally imagable coating that when activated the second thermally imagable coating forms a color. An extender coating overlies the second thermally imagable coating and a top coating further overlies the extender coating. In another embodiment, the first surface supports a plurality of thermally imagable coatings such that when activated the plurality of coatings form a plurality of colors.

Aspects of the invention are also directed to a method of preparing thermally imagable media. The method comprises providing a substrate supporting a first and second surface, applying a first thermally imagable coating on the first surface, applying an extender coating over the first thermally imagable coating, and applying a top coating over the extender coating such that, when activated, the thermally imagable coating produces a color. In certain embodiments, the extender coating is applied with a 2.0-6.0 bcm anilox roller. In a further embodiment, the substrate is a clay-coated paper stock, such as a calcite-clay coated paper stock.

In another embodiment, the method further comprises applying an adhesive to the second surface of the substrate and subsequently applying a release liner to the adhesive. In certain embodiments, the method of preparing thermally imagable media further comprises applying a second thermally imagable coating to the first surface such that when activated, the second thermally imagable coating produces a color. In another embodiment, the method further comprises applying a plurality of thermally imagable coatings to the first surface of the substrate to produce a plurality of colors.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 3 shows thermally imagable media comprising a plurality of thermally imagable coatings structured in accordance with one embodiment of the present invention;

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

As used herein, the term "thermally imagable media" refers to paper, business records, labels, wristbands, tags, or other similar material configured for direct thermal printing. "Thermally imagable record" is used to refer to an individual thermally imagable medium. The term "color chemistry" is used to refer to a formulation comprising at least one colorformer, developer, and sensitizer. A "colorformer" is a dye that changes color upon a change in pH. A "developer" is an acid that enables the color change in the colorformer. A "sensitizer" is a low melting point solid that preserves the colorformer and developer in a matrix when the sensitizer is in its solid state. The term "thermally imagable coating" refers to a formulation comprising color chemistry configured to overlie a substrate for direct thermal printing.

The term "extender coating" refers to an intermediate coating applied over a thermally imagable coating and under a top coating. The extender coating is a clear coating that allows the color change in the thermally imagable coating to be visible to the human eye. The term "top coating" refers to a protective coating applied over the thermally imagable coating and extender coating before direct thermal printing. The top coating is a clear coating that allows the color change in the thermally imagable coating to be visible to the human eye.

Also, as used herein, a "colorant" is a dye or pigment and an "ink" is a liquid or paste comprising a vehicle, evaporate, colorant, and additives.

Figure 1:
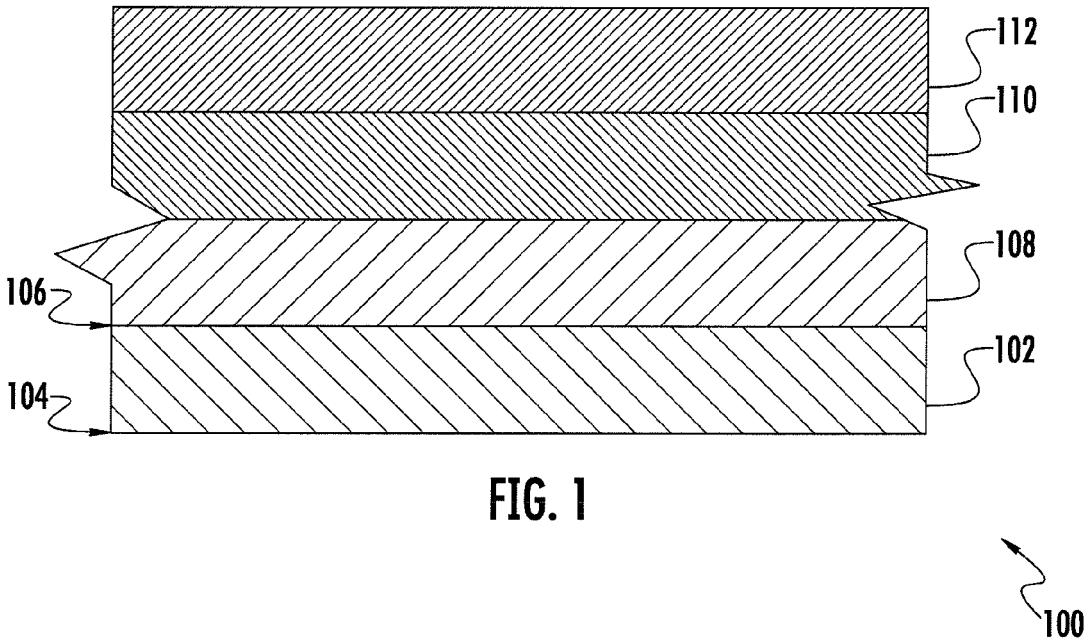
FIG. 1 is a cross-sectional view of thermally imagable media structured in accordance with one embodiment of the present invention.

FIG. 1 is a cross-sectional view of a thermally imagable record 100 structured in accordance with one embodiment of the present invention. The depicted thermally imagable record 100 comprises a substrate 102 defining a first surface 104 and a second surface 106. The first surface 104 supports a thermally imagable coating 108, an extender coating 110, and a top coating 112. The extender coating 110 overlies the thermally imagable coating 108, and the top coating 112 overlies the extender coating 110. In some embodiments, the thermally imagable coating 108 overlies a portion or all of the substrate. In still other embodiments, the extender coating overlies a portion or all of the thermally imagable coating and the top coating overlies a portion or all of the extender coating. In the depicted embodiment, the extender coating overlies the thermally imagable coating such that the thermally imagable coating is sealed from subsequently applied layers.

Figure 2:
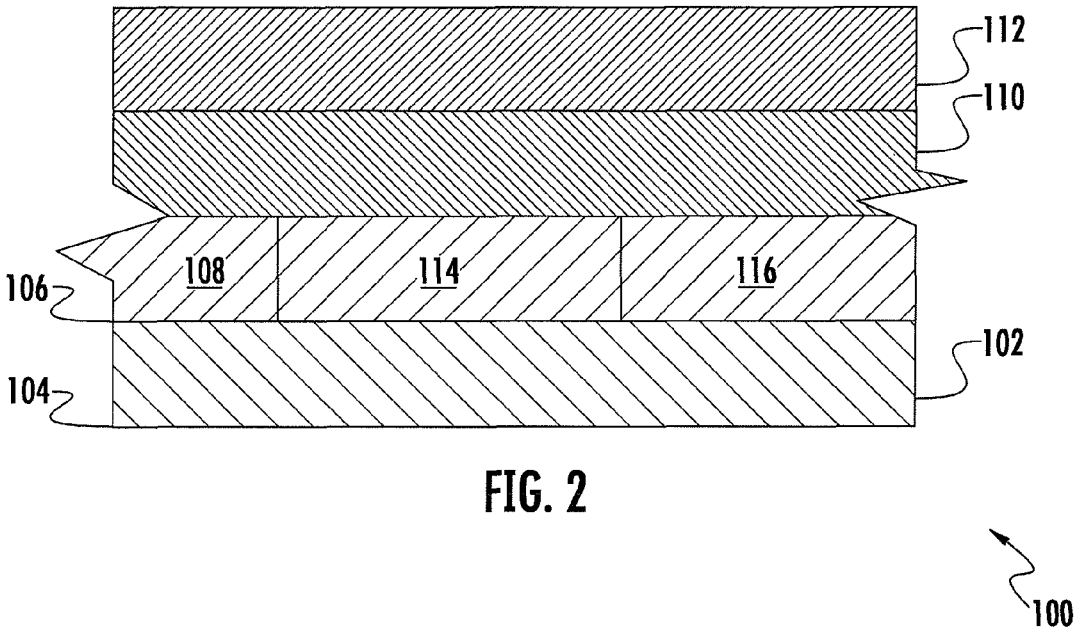
FIG. 2 is a cross-sectional view of thermally imagable media comprising a plurality of thermally imagable coatings structured in accordance with another embodiment of the present invention.

In certain embodiments, the first surface 104 supports more than one thermally imagable coating. For instance, as shown in FIG. 2, the first surface 104 supports a first thermally imagable coating 108, a second thermally imagable coating 114, and a third thermally imagable coating 116. An extender coating 110 overlies one or more of the thermally imagable coatings 108, 114, and 116. A top coating 112 overlies the extender coating 110.

The substrate is any suitable material capable of receiving the thermally imagable coating. The substrate is any suitable paper, film, plastic, foil, fabric or similar material. Preferably the substrate is paper, for example direct thermal paper stock or thermal transfer paper stock. In some embodiments, the paper stock is coated prior to application of thermally imagable coatings. The coating is any suitable coating that facilitates application of a thermally imagable coating. For instance, in some embodiments, the paper stock has a clay coating, such as a calcite clay coating. It has been discovered through trials and experiments that clay coatings with low acidity provide high quality images. The high acidity in some clay coatings may cause pre-imaging to take place due to the interaction between the clay coating and the color chemistry in the thermally imagable coating. The acidity in the coating initiates the color change in the dyes causing an unsaturated faded color to form. One suitable coated paper stock that avoids the pre-image issue is the New Page Unitherm paper. In certain embodiments, the substrate is pre-printed with colors, images, words, or other indicia prior to application of the thermally imagable coating.

The thermally imagable coating comprises a colorformer and developer that react to create a color change in the colorformer. The colorformer comprises any suitable dye that changes color with a change in pH. For instance, in some embodiments, the colorformer is a leuco dye. Leuco dyes are initially colorless but form a color when protonated. The colorformers are chosen to form a desired color when in an acidic environment and comprise at least one of cyan, magenta, yellow, and black. In some embodiments, at least two of cyan, magenta, yellow, and black are combined in any one of the thermally imagable coatings. More than one of cyan, magenta, yellow, and black may be used at any time. For instance, in one embodiment all of the colors, cyan, magenta, yellow, and black, are used in a thermally imagable coating. The relative amounts of cyan, magenta, yellow, and black will vary depending on the desired color.

The color developers are any suitable acid that will react with the colorformer to cause a change in color. Developers are often weak acids. For instance, in one embodiment, the developer is one of zinc salicylate, acetylated phenolic resins, salicylic acid modified phenolic resins, zincated phenolic resins, novolac type phenolic resins, and other monomolecular phenols such as bisphenol A, 4,4'-isopropylidene diphenol, 4,4'-sulfonyl diphenol, p,p' (1-methyl-n-hexylidene) diphenol, p-tert-butyl phenol, and p-phenyl phenol, alone or in combination. The relative amounts of colorformers and developers are modified to change the color intensity of the printed record.

The thermally imagable coating additionally comprises a sensitizer that when heated melts to allow the colorformer and developer to come into contact and react. The sensitizer is a low melting point solid. In some embodiments, the sensitizer is any one of B-naphthol benzyl ether, p-benzyl biphenyl, ethylene glycol-m-tolyl ether, m-Terphenyl, Bis[2 (4-methoxy) phenoxy]ether, phenyl 1-hydroxynaphthoate, and dibenzyl oxalate, alone or in combination. The sensitizers melt at temperatures less than 150° C., preferably around 100° C. or lower. Removal of heat from the thermal printhead allows the sensitizer to solidify. The colorformer is thus maintained in its new color state.

In certain embodiments, a high melting point developer is mixed with a low melting point sensitizer. For instance, in one embodiment, bisphenol A, which has a melting point of 156° C., is mixed with phenyl 1-hydroxynaphthoate, which has a melting point of 95° C. The mixture allows for vivid and stable color due to the higher melting point developer and higher thermal sensitivity due to the lower melting point sensitizer. The higher thermal sensitivity enables higher print speeds.

In one embodiment, the thermally imagable coating comprises polymer solids and water. For instance, the polymer solids comprises about 50% by weight or less of the coating, preferably less than 40%, more preferably 30-40% of the coating. Water comprises over 50% by weight of the coating, preferably over 60%, more preferably about 60-70% of the coating. In a further embodiment, the polymer solids content comprises a resin or binder in addition to the colorformer, developer, and sensitizer. The resin or binder is any one of starch, casein, polyvinyl alcohol, acrylate copolymers, carboxylated styrene butadiene latex, styrene acrylic latex, and mixtures thereof. In some embodiments, the polymer solids comprise one or more filler added to provide desired characteristics to the coating, such as a lubricant or anti-fading agent.

In some embodiments, the solids content of the thermally imagable coating comprises 50% by weight or less resin or binder, preferably 30% or less, more preferably about 10-30% resin or binder. The solids content comprises 30% by weight or less colorformer, preferably 15% or less, more preferably about 5-15% colorformer. The solids content comprises 40% by weight or less developer, preferably 30% or less, more preferably about 15-30% developer. The solids content comprises 40% by weight or less sensitizer, preferably 30% or less, more preferably about 15-30% sensitizer. The solids content comprises 40% by weight or less filler, preferably 30% or less, more preferably about 15-30% filler. These components are not limited to the recited relationships and the relative amounts will vary based on required color intensity, thermal printing properties, coat weight requirements, and/or application method. In certain embodiments, the thermally imagable coating preferably is free of amines. The inventors have found the extender coating and top coating are particularly effective when the thermally imagable coating is free of amines.

In some embodiments, the thermally imagable coating overlies certain desired areas of the substrate such that only these areas can be activated to change color. The extender coating is applied over each of these areas and, in some embodiments, is applied over the remaining areas of the substrate to fully seal the first surface. The top coating overlies the extender coating.

In another embodiment, more than one thermally imagable coating is applied to the substrate. In this embodiment, the thermally imagable coatings are applied to different areas of the substrate. As shown in FIG. 3, the first thermally imagable coating 108 is applied to one area of the substrate 102 while the second 114, third 116, and forth 118 thermally imagable coatings are placed in other areas of the substrate 102. The thermally imagable coatings are in any arrangement to produce desired symbols, images, words, or other indicia when activated. For instance, in some embodiments, the thermally imagable coatings form barcodes, logos, and/or graphics when activated. In one embodiment, the thermally imagable coating forms a variety of fonts and character sizes depending on the programming of the printhead. The thermally imagable coatings are activated to produce a variety of colors or the same colors.

In some embodiments, an extender coating is applied over the thermally imagable coating. The extender coating overlies a portion or all of the thermally imagable coating. The extender coating overlies the thermally imagable coating such that the color chemistry is sealed from subsequent layers. The extender coating is an ink without a colorant and is preferably a water soluble ink without a colorant. The extender coating is applied to the thermally imagable coating such that the thermally imagable coating produces a visible color change when activated.

The extender coating comprises a vehicle (binder) and an evaporate. In certain embodiments, the extender coating comprises acrylic resins, such as acrylic emulsion resins and/or acrylic solution resins, as the vehicle and water as the evaporate. These resins impart desired characteristics to the ink such as gloss, matte, drying requirements, and printability. In some embodiments, the extender coating comprises additives such as amines, waxes, silicones, defoamers, and surfactants, alone or in combination. These additives promote certain properties of the coating and are used in any suitable amount to obtain the desired properties of the coating.

In some embodiments, the extender coating comprises 60% by weight or less polymer solids, preferably 50% or less, more preferably 45% or less. The evaporate will flash off when the record is dried. The solids content of the extender coating comprises 70% by weight or more acrylic emulsion resin, preferably 80% or more, more preferably 85% or more acrylic emulsion resin. The solids content comprises 15% by weight or less acrylic solution resin solids, preferably 10% or less. The solids content comprises 15% by weight or less other solids such as wax, preferably 10% or less. These components are not limited to the recited relationships and the relative amounts will vary based on required color intensity, thermal printing properties, coat weight requirements, and/or application method.

The extender coating is applied by any suitable means, such as flexographic or gravure printing, preferably flexographic printing. When using flexographic printing, the extender coating is applied using a 1.0 to 10.0 bcm (billion cubic microns) anilox roller, preferably a 2.0 to 8.0 bcm anilox roller, and more preferably a 2.0 to 6.0 bcm anilox roller. The inventors have found that care should be used in selecting the anilox roller used to apply the extender. An extender coating weight too high or too low will result in lower quality product. For instance, a coat weight too low will not seal the thermally imagable coating and will instead, allow for buildup of color chemistry on the thermal printhead. This buildup then results in dirty print and an overall lower print quality. A coat weight too high will cause print quality issues as the images look mottled, less intense, or faded.

In certain embodiments, a top coating overlies the extender coating. The top coating overlies a portion or all of the extender coating. In certain embodiments, the top coating directly overlies the thermally imagable coating and/or directly overlies the extender coating. In some embodiments, the top coating directly overlies the thermally imagable coating in some areas of the substrate while the top coating directly overlies the extender coating which overlies the thermally imagable coating in other areas of the substrate.

The top coating is an ink without a colorant. In one embodiment, the top coating is a water-soluble ink without a colorant. In certain embodiments, the top coating comprises clay, polymer solids, and water. The clay is any suitable clay, such as kaolin clay. In one embodiment, the top coating comprises 20% by weight or less clay, preferably 10% or less, more preferably 5-10% clay. The top coating comprises 30% by weight or less polymer solids, preferably 20% or less, more preferably 10-20% polymer solids. The top coating also comprises 70% by weight or more water, preferably 80% or more, more preferably 80-85% water.

The top coating is composed of materials designed to provide transport and protection through the thermal printer. In some embodiments, the composition is based on a water soluble polymer that is rendered water insoluble using crosslinking agents. Additional functional fillers composed of a mild, non-abrasive scrubber material and a wax-like lubricant are incorporated in balance to provide cleaning and quiet transport. The relationship of these components varies based on optimizing viscosity, printer condition, minimizing coat weight, and application method. The polymer solids comprise one or more water soluble polymers, crosslinking agents, and fillers. The polymer solids comprise less than 90% by weight one or more water soluble polymers, preferably 80% or less, more preferably 40-80% water soluble polymer. The polymer solids comprise 20% by weight or less one crosslinking agent, preferably 10% or less, more preferably 5-10%. The polymer solids comprise 20% by weight or less a second crosslinking agent, preferably 10% or less, more preferably 5-10%. The polymer solids comprise about 20% by weight or less one functional filler, preferably 15% or less, more preferably 10-15%. The polymer solids comprise about 20% by weight or less a second functional filler, preferably 15% or less, more preferably 10-15%.

The inventors have found that the extender coating in conjunction with the top coating provides a printed record with improved quality. As thermal paper moves through a direct thermal printer, color chemistry tends to collect on the thermal printhead. The collected color chemistry is then deposited elsewhere on the paper resulting in smearing or dirty images. To prevent this physical transfer, the user is forced to clean the printhead at higher than optimum levels. The inventors have found the use of the extender coating in combination with the top coating prevents or mitigates this buildup and results in cleaner images.

Additionally, some protective coatings actually react with the color chemistry creating a faded or muted color change prior to printing. This "pre-image" can cause many issues both aesthetically and functionally. For instance, when printing a barcode, if the background prematurely grays due to the color chemistry reacting with the protective coating, the final printed barcode will have a reduced contrast ratio between the printed bars and spaces. This can lead to either an inability to read the barcode or a misreading of the barcode.

The combination of the extender coating and top coating reduces the amount of color chemistry collected on the thermal printhead. The combination also prevents pre-imaging from occurring as the extender prevents interaction between the top coating and color chemistry while still obtaining the benefits of the top coating, such as protection from the environment. While various configurations are possible, the inventors have found the combination of the extender coating on the thermally imagable coating and under the top coating produced the most favorable results. The printed images were more defined and cleaner. When the extender coating was used without the top coating, sticking issues occurred as well as poor print quality. The inventors additionally have found the use of low-acidity, clay-coated substrates further prevents or mitigates pre-imaging.

Figure 4:
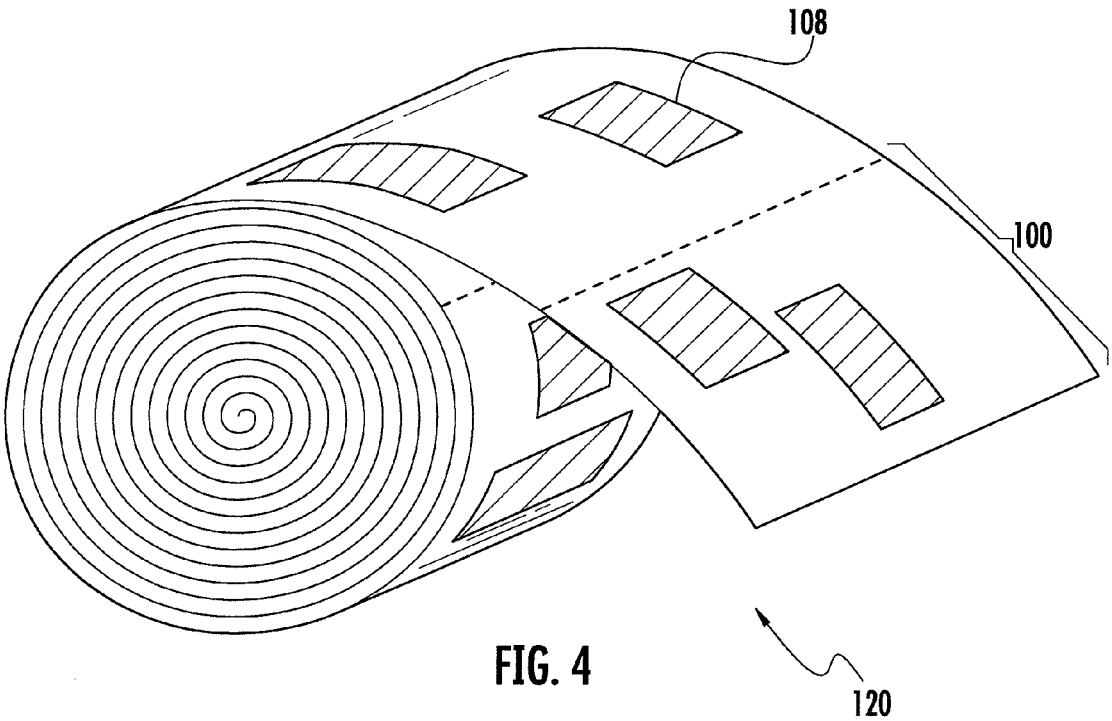
FIG. 4 shows a continuous web comprising a series of thermally imagable records structured in accordance with one embodiment of the present invention.

In certain embodiments, a continuous web is formed of thermally imagable media. Referring to FIG. 4, the continuous web 120 comprises a series of thermally imagable coatings 108 that produce one or more colors in various shapes once activated. The continuous web 120 comprises a series of thermally imagable records 100 each with thermally imagable coatings 108. The individual records 100 are separated by perforations or rouletting and are wound or stacked to form a continuous web 120.

The thermally imagable media includes paper, business records, labels, wristbands, tags, or other similar items. For instance, the thermally imagable media includes shipping labels, including compliance labels; receipts; pick tickets; event tickets; coupons; citations or parking tickets; name tags; visitor passes; airline tickets; and more. The thermally imagable records are produced individually, in sheets, or in a continuous web.

In some embodiments, the thermally imagable media is configured to be affixed to a surface. The thermally imagable media includes a layer of adhesive and a release liner configured such that the media may be affixed to a desired surface. For instance, in one embodiment, the second surface of the substrate supports a layer of adhesive and a release liner. The adhesive is any suitable adhesive such as a pressure sensitive adhesive and is permanent, removable, or repositionable. The release liner is any one of paper, foil, film, fabric, plastic, or other similar material configured to be removed from the adhesive to allow the thermally imagable media to be affixed to another surface.

In an alternative embodiment, the present invention comprises a method of preparing thermally imagable media. The thermally imagable media includes paper, business records, labels, wristbands, tags, or other similar items. The method comprises providing a substrate having a first and second surface, applying a first thermally imagable coating on the first surface, applying an extender coating over the first thermally imagable coating, and applying a top coating over the extender coating such that when activated, the thermally imagable coating produces a color.

Figure 5:
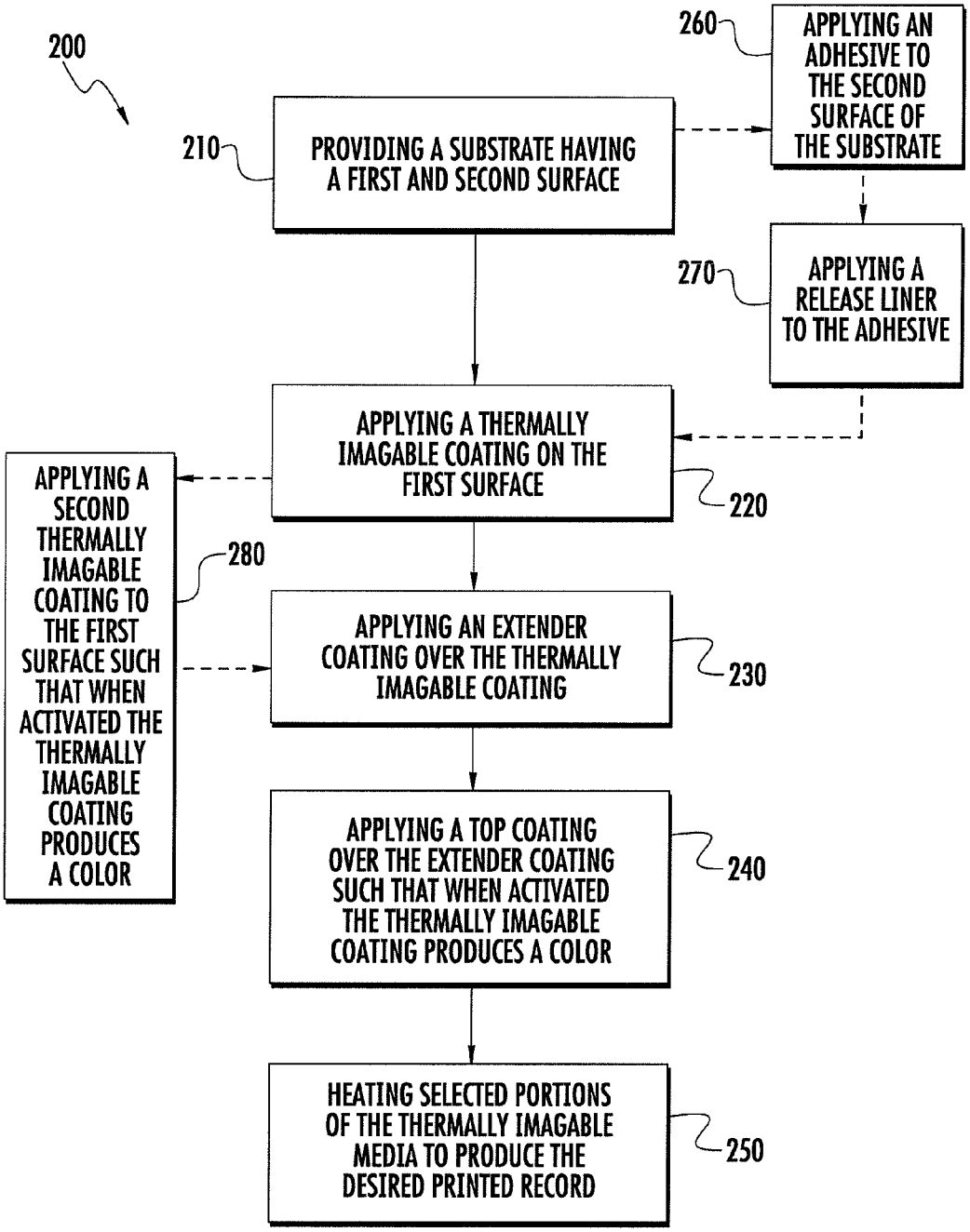
FIG. 5 is a schematic flow diagram illustrating a method for producing thermally imagable media comprising optional processing steps for various embodiments of the present invention.

FIG. 5 depicts a method 200 of preparing thermally imagable media. The method comprises providing a substrate with a first and second surface 210. A thermally imagable coating is applied to the first surface 220. The extender coating is applied to the thermally imagable coating 230. The extender coating is applied such that when activated, the thermally imagable coating produces a color. The top coating is subsequently applied to the extender coating 240. As illustrated in FIG. 5, in some embodiments, the method of preparing thermally imagable media further comprises heating selected portions of the thermally imagable media to produce the desired printed record 250. The thermally imagable media is heated 250 to activate the thermally imagable coating producing a record with visible, color images. In one embodiment, the top coating is applied directly over the thermally imagable coating. In certain areas of the substrate, the top coating is applied over the extender coating while in other areas the top coating is applied directly over the thermally imagable coating.

The coatings are applied in any suitable manner to sufficiently coat the substrate. The coatings are applied by flexographic or gravure printing, preferably flexographic printing. The thermally imagable coating is applied in any suitable amount to achieve the desired printed record. For example, the thermally imagable coating is applied with a 1.0 to 12.0 bcm anilox roller, preferably with a 8.0 to 10.0 bcm anilox roller, and more preferably with a 8.5 to 10.0 bcm anilox roller. The extender coating is applied in any suitable amount to seal the thermally imagable coating and produce the desired printed record. For example, the extender coating is applied with a 1.0 to 10.0 bcm anilox roller, preferably with a 2.0 to 8.0 bcm anilox roller, and more preferably with a 2.0 to 6.0 bcm anilox roller.

The top coating is applied in any suitable amount to achieve the desired printed record. In certain embodiments, a higher coating weight of the top coating as compared to the other coatings is desired. For example, in some embodiments, the top coating is applied with a 1.0 to 14.0 bcm anilox roller, preferably with a 2.0 to 14.0 bcm anilox roller, and more preferably with a 8.0 to 14.0 bcm anilox roller. In certain embodiments, the top coating is applied using an anilox roller without an associated doctor blade to achieve a higher coating weight. For instance, in certain embodiments, the top coating is applied with a 14 bcm anilox roller with no doctor blade, such as an Apex XXL anilox roller. Without intending to be bound by theory, by applying the top coating with a higher anilox roller and without a doctor blade, the maximum coat weight can be applied and dried while maintaining a reasonable press speed. For instance, depending on the drying capabilities of the press, the press speed can be from 50 fpm (feet per minute) to 300 fpm, preferably 100 fpm to 200 fpm.

The thermally imagable media is heated 250 to activate the thermally imagable coating or coatings in any suitable direct thermal printer, such as mobile, card, desktop, or kiosk printers as well as high volume industrial printers. The thermally imagable media is heated to a temperature sufficient to melt the sensitizer of the thermally imagable coating and allow the colorformer and developer to react forming a color change.

As also shown in FIG. 5, the method of preparing thermally imagable media comprises additional steps according to certain embodiments of the invention. These additional steps may be incorporated individually or in any combination as illustrated by the dashed lines in FIG. 5. In one embodiment, the method comprises application of an adhesive to the second surface of the substrate 260 followed by application of a release liner to the adhesive 270. In certain embodiments, a second thermally imagable coating is applied to the first surface of the substrate 280. As shown in FIG. 5, in certain embodiments using a second thermally imagable coating, the second thermally imagable coating is applied such that when activated the thermally imagable coating produces a color. In other embodiments, not illustrated, the method comprises application of additional thermally imagable coatings. In these embodiments, the thermally imagable coatings produce visible colors when heat activated. The additional coatings produce the same color or a variety of colors. In certain embodiments, the method further comprises applying a coating to the substrate prior to application of the thermally imagable coating. This initial coating is a clay coating with low acidity. In other embodiments, the substrate is pre-coated with a clay coating and/or pre-printed with images, words, or other indicia.

Experimental Procedure

Various coatings and coat weight were tested to reduce printhead buildup and prevent pre-imaging. Ultra Imaging Extender from Environmental Inks®, EH012393, XPR1M10100, and Opaque White Ultra Imaging ink were tested on top of a layer of IQ Color Chemistry and under a layer of IQ Color Water Based Clear Top Coat, both from Iimak®. The coatings were tested in a Zebra QLn 320 printer utilizing Zebra IQ Color Labels. The Ultra Imaging Extender from Environmental Inks®, EH012393, XPR1M10100, and Opaque White Ultra Imaging ink coatings were applied using a flexographic printing technique with anilox rollers from 2.0 to 7.5 bcm. The IQ Color Chemistry was applied using a 8.5 bcm or 10.0 bcm anilox with a doctor blade. The IQ Color Water Based Clear Top Coat was applied using an Apex XXL anilox roller (14 bcm) without an associated doctor blade to achieve a higher coating weight.

Various patterns were printed and a full roll of labels were printed in each trial for comparison. Pictures of the thermal printhead buildup were taken after printing to determine the reduction in printhead buildup. Other Zebra printers were tested; however, the Zebra QLn 320, a mobile printer, resulted in the worst case scenario for IQ Color printhead build up.

In addition, the optical print density of the printed black image was measured to determine whether the extender coating caused a loss of print density or print image quality. The target print density was 0.88 ODU (optical density units) to 1.0 ODU. The print density was measured with a X-Rite 400 reflective densitometer or similar piece of equipment.

Test Results

Ultra Imaging Extender was found to provide the best quality images when in combination with the IQ Color Chemistry and IQ Color Water Based Clear Top Coat. Additionally, using a 2.0 to 6.0 bcm anilox roller provided the best results. The inventors found little or no visible build up after one roll of labels in a Zebra QLn 320 printer. The reduced buildup on the thermal printhead led to reduced smearing or dirty images. The inventors also found the extender coating sufficiently sealed the thermally imagable coating preventing pre-imaging. Thus, the printed images were cleaner and more defined. The Ultra Imaging Extender resulted in a product with an optical print density within the target range of 0.88 ODU to 1.0 ODU.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. Thermally imageable media in which selected areas may be activated to form color areas comprising:

a substrate having a first surface and a second surface, wherein the substrate is a clay coated paper stock, the first surface supporting:

a thermally imageable coating;

an extender coating, which overlies the first thermally imageable coating; and a top coating, which overlies the extender coating such that when activated the thermally imageable coating produces a color, wherein the extender coating comprises acrylic resin, wax, and water.

2. Thermally imageable media of claim 1 wherein the extender coating is applied with a 2.0 to 6.0 bcm anilox roller.

3. Thermally imageable media of claim 1 wherein the extender coating is a coating without a colorant.

4. Thermally imageable media of claim 1 wherein the thermally imageable coating comprises a colorformer and developer.

5. Thermally imageable media of claim 4 wherein the colorformer comprises at least one of cyan, magenta, yellow, and black.

6. Thermally imageable media of claim 4 wherein the colorformer comprises at least two of cyan, magenta, yellow, and black.

7. Thermally imageable media of claim 4 wherein the colorformer comprises cyan, magenta, yellow, and black.

8. Thermally imageable media of claim 1 wherein the thermally imageable coating comprises 30-40% polymer solids and 60-70% water.

9. Thermally imageable media of claim 1 wherein the top coating is a coating without a colorant.

10. Thermally imageable media of claim 1 wherein the top coating comprises a water soluble polymer, crosslinking agents, and fillers.

11. Thermally imageable media of claim 1 wherein the top coating comprises 5-10% clay, 10-20% polymer solids, and 80-85% water.

12. Thermally imageable media of claim 1, wherein the thermally imageable media is a continuous web for producing a series of thermally imageable records.

13. Thermally imageable media of claim 1 wherein the thermally imageable coating is activated to form at least one of a symbol, image, and word.

14. Thermally imageable media of claim 1 wherein the first surface further supports a second thermally imageable coating such that when activated the second thermally imageable coating forms a color.

15. Thermally imageable media of claim 14 wherein the extender coating overlies the second thermally imageable coating and the top coating overlies the extender coating.

16. Thermally imageable media of claim 1 wherein the first surface has a plurality of thermally imageable coatings on the first surface such that when activated the plurality of coatings form a plurality of colors.

17. A method of preparing thermally imageable media, the method comprising:

providing a substrate having a first surface and a second surface, wherein the substrate is a clay coated paper stock;

applying a first thermally imageable coating on the first surface;

applying an extender coating over the first thermally imageable coating; and applying a top coating over the extender coating such that when activated the thermally imageable coating produces a color, wherein the extender coating comprises acrylic resin, wax, and water.

18. The method of claim 17 wherein the applying an extender coating comprises applying the coating with a 2.0-6.0 bcm anilox roller.

19. The method of claim 17 further comprising applying an adhesive to the second surface of the substrate.

20. The method of claim 19 further comprising applying a release liner to the adhesive.

21. The method of claim 17 further comprising applying a second thermally imageable coating to the first surface such that when activated the second thermally imageable coating produces a color.

* * * * *